United States Patent [19]

Davenport

[11] 4,338,058

[45] Jul. 6, 1982

[54] SYNCHRONIZED HOPPER GATE

[75] Inventor: Joseph P. Davenport, Picton, Canada

[73] Assignee: Allis-Chalmers Canada Inc., Quebec, Canada

[21] Appl. No.: 155,548

[22] Filed: Jun. 2, 1980

[51] Int. Cl.[3] ..... B65G 67/58

[52] U.S. Cl. ..... 414/144; 105/240; 222/503

[58] Field of Search ..... 414/144; 298/27; 105/240, 282 R; 222/503; 49/123

[56] References Cited

U.S. PATENT DOCUMENTS

| | | | |
|---|---|---|---|
| 1,198,896 | 9/1916 | Davis | 49/123 |
| 3,415,014 | 12/1968 | Hamilton | 49/123 X |
| 3,986,622 | 10/1976 | Vaughan et al. | 414/144 |
| 3,990,588 | 11/1976 | Dibben | 414/144 |
| 4,004,700 | 1/1977 | Empey | 414/144 |
| 4,009,906 | 3/1977 | Sweet et al. | 298/27 |
| 4,024,965 | 5/1977 | Marth et al. | 414/64 X |
| 4,271,755 | 6/1981 | Kintgen et al. | 414/82 X |

*Primary Examiner*—Leslie J. Paperner

*Attorney, Agent, or Firm*—Charles L. Schwab

[57] ABSTRACT

Synchronized hopper gate mechanisms (17) are provided for the hoppers (18) of a bulk cargo vessel (11). Each gate mechanism includes a pair of horizontal closure panels (31, 32) and control means for simultaneously displacing the panels in opposite directions. The control means includes a pair of endless chain means (79, 81), cooperating sprockets (82, 83, 84, 86) and a torque transmitting means in the form of a shaft (101) interconnecting sprockets (83, 86) which forces the corresponding runs of the chain means (79, 81) to move in the same direction at the same speed to effect synchronized translational movement of the closure panels (31, 32).

3 Claims, 7 Drawing Figures

SYNCHRONIZED HOPPER GATE

FIELD OF THE INVENTION

This invention relates to a hopper gate mechanism for unloading bulk material from a bulk cargo ship or the like and is particularly concerned with synchronizing movement of a pair of closure panels of a hopper gate.

BACKGROUND OF THE INVENTION

Heretofore, others have suggested various gate arrangements for controlling the gravity discharge of free flowing or fluid bulk material from containers such as the holds of a bulk cargo ship. U.S. Pat. Nos. 3,990,588 and 4,004,700 show hoppered bottom ships, wherein the flow of material from each hopper is controlled by a pair of gates supported by rollers which run on horizontal parallel tracks. In order to have proper control of the rate of discharge, it is desirable to synchronize the opening and closing of the gates. U.S. Pat. No. 4,009,906 illustrates a metering gate for a fluid bulk material hopper wherein a motion balancing mechanism interconnects a pair of closure panels for equalizing the distances through which the panels are displaced by a drive mechanism. A lag elimination mechanism is utilized so that each portion of each panel is displaced in equal amounts as the closure panels are opened and closed by the drive mechanism. The synchronizing of a pair of elevator door panels is achieved by a sprocket and chain arrangement in U.S. Pat. No. 1,198,896.

SUMMARY OF THE INVENTION

A synchronized gate mechanism is provided for metering gravity discharge of fluid bulk material from a vertically oriented discharge opening at the bottom of a hopper or the like. A pair of horizontally disposed closure panels at the discharge opening are supported by support means for translational movement in opposite horizontal directions between open and closed positions including horizontal tracks along opposite sides of the discharge opening which support opposite end portions of the closure panels. Control means are employed to simultaneously displace the closure panels in opposite directions toward one another to their closed position and for simultaneously displacing the closure panels away from one another to their open position. The control means include first and second pairs of sprockets on parallel horizontal axes transverse to the direction of movement of the panels and supporting first and second endless chain means lying alongside the support means. Each of the chain means have a pair of runs which move in opposite horizontal directions, that is in the same directions as the panels move when opening or closing. A first pair of fastening means connect opposite end portions of one panel to one set of corresponding runs of the first and second chain means and a second pair of fastening means connect opposite end portions of the other panel to the other set of corresponding runs of the first and second chain means. Torque transmitting means are used to interconnect one of the first pair of sprockets to one of the second pair of sprockets whereby corresponding runs of the first and second chain means move in the same direction at the same speed thereby effecting synchronized translational movement of the closure panels.

The invention has particular utility in a self-unloading bulk cargo ship wherein the synchronized gate mechanism controls gravity flow of bulk material from the bottom hoppered holds onto an underlying endless belt conveyor. The structure supporting the tracks for the gate closure panels may also support the frame structure rotatably mounting the support rollers for the underlying endless belt. The closure panels may be provided with a pair of support rollers at each of their longitudinal ends which rollingly engage the horizontal tracks of the support means and the torque transmitting means may include a shaft coaxially interconnecting two of the four sprockets for unitary rotation. In order to make efficient use of vertical space and power for operation of the closure panels, the panels and the axes of the sprockets and rollers may lie substantially in a horizontal plane.

DETAILED DESCRIPTION OF THE DRAWINGS

Figure 1:
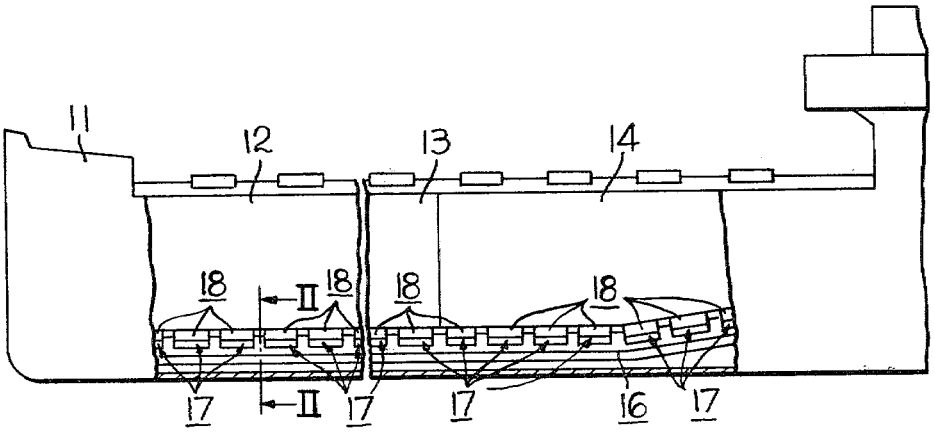
FIG. 1 is a side view of a bulk cargo vessel with portions broken away for illustration purposes.

Referring to FIG. 1, the present invention may be used for controlling the gravity discharge fluid bulk material, such as iron ore pellets, crushed rock or the like from the holds of a vessel or ship 11. The ship has a plurality of hoppered holds 12, 13, 14 which discharge material onto an endless belt conveyor 16 through longitudinally aligned gate mechanisms 17 below the hoppers 18 at the bottom of the holds.

Figure 4:
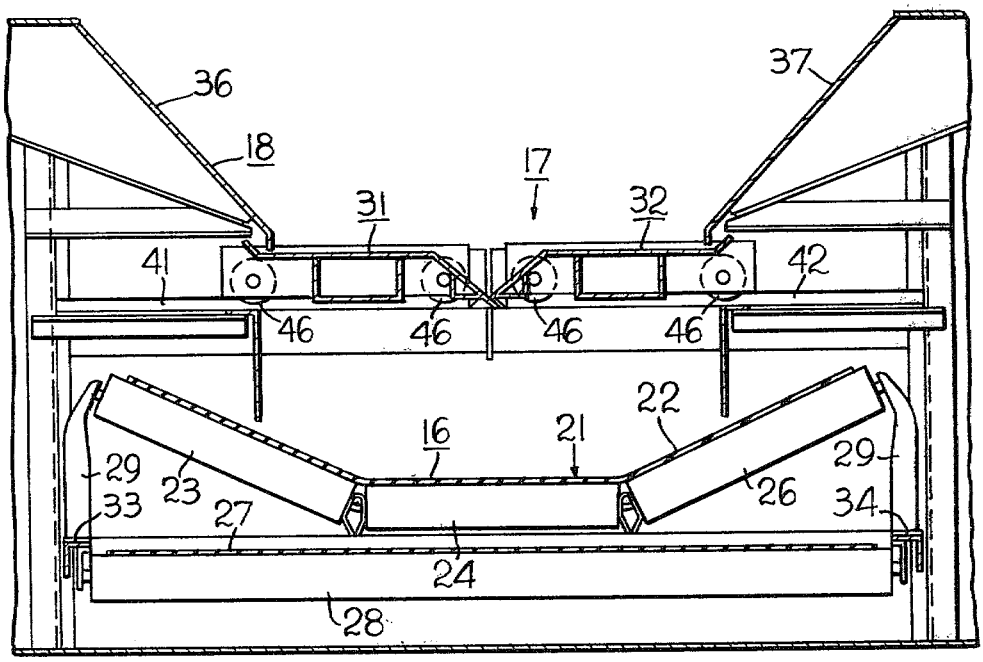
FIG. 4 is a view taken along the line IV—IV in FIG. 3.
Figure 2:
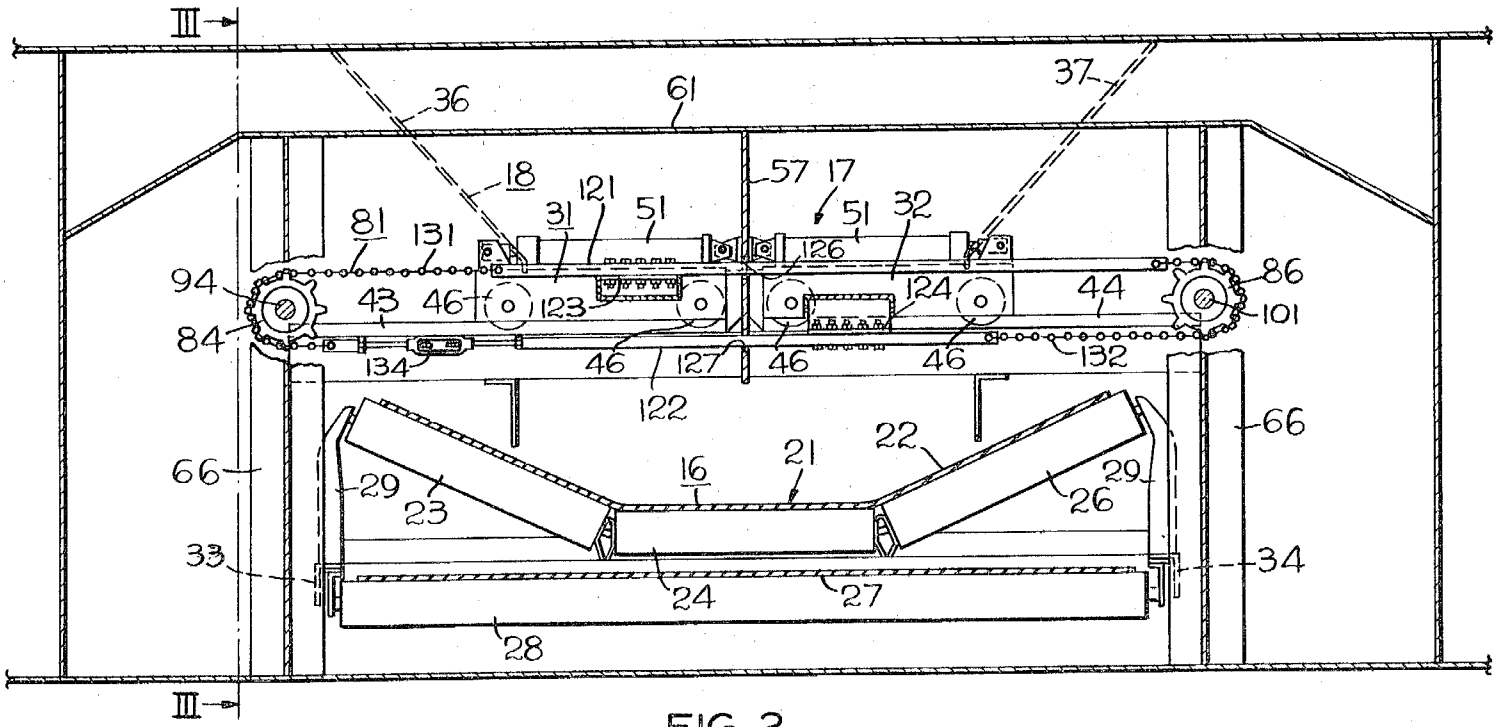
FIG. 2 is a view taken along the line of II—II in FIG. 1.
Figure 3:
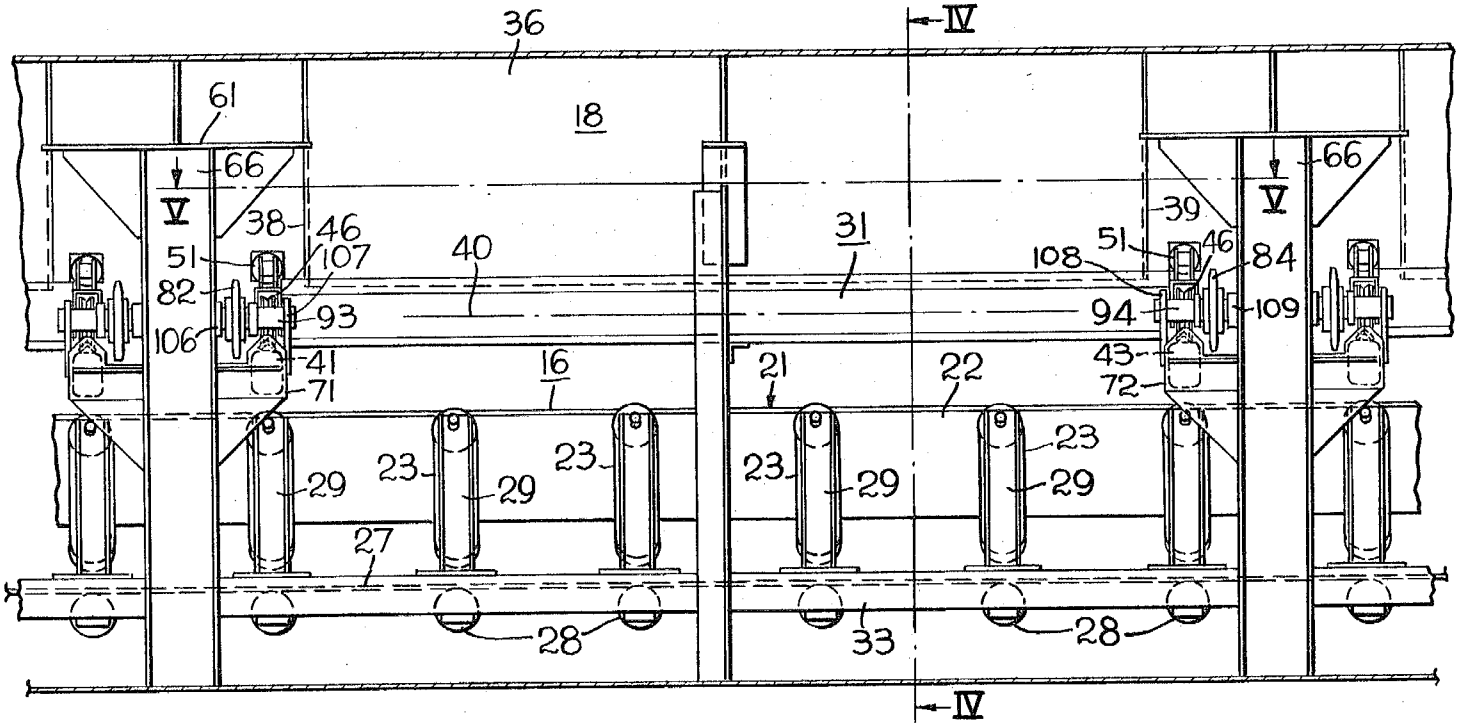
FIG. 3 is a view taken along the line III—III in FIG. 2.
Figure 6:
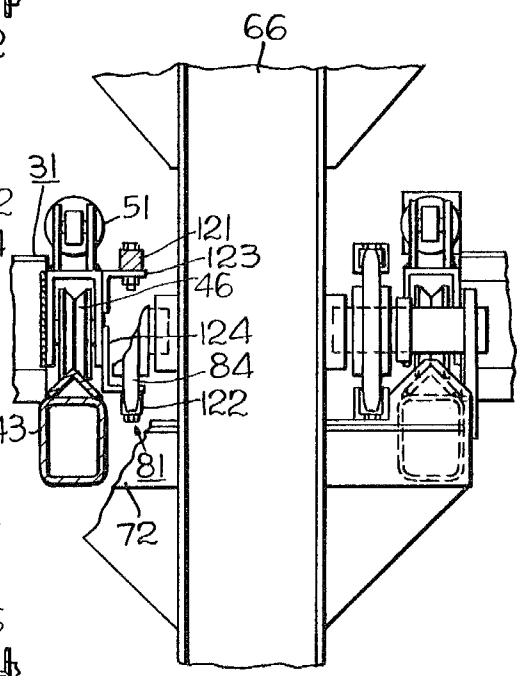
FIG. 6 is a view taken along the line VI—VI in FIG. 5.

Referring to FIGS. 2, 3 and 4 the endless belt conveyor 16 includes an endless belt 21 having an upper working run 22 supported by troughing rollers 23, 24, 26 and a lower return run 27 supported by a plurality of support rollers 28. The rollers 23, 24, 26, 28 are rotatably mounted on support frames 29 which are rigidly secured to longitudinal beams 33, 34. The beams are in turn rigidly secured to upright supports in the form of H-beams 66. The conveyor belt 21 is driven by an appropriate drive means, not shown, during a ship unloading operation.

Each gate mechanism 17 includes a pair of closure panels 31, 32 disposed below its associated hopper 18 at the bottom of the holds of the ship. As shown in FIGS. 2–5, each hopper 18 has a pair of downwardly converging sidewalls 36, 37 and a pair of longitudinally spaced endwalls 38, 39. The closure panels 31, 32 are rectangular in horizontal configuration and lie in a common horizontal plane 40. The panels 31, 32 are mounted on longitudinally spaced parallel tracks 41, 42, 43 and 44 by pairs of rollers 46 rotatably mounted on each of the opposite longitudinal ends of the two closure panels on horizontally spaced, coplanar axes extending transverse to the direction of movement of the panels. The tracks 41, 42 are aligned with one another and have their inboard ends welded to a vertical wall 56. In like manner, tracks 43, 44 are in alignment and have their inboard ends welded to a vertical wall 57.

The closure panels 31, 32 are operated by control means which simultaneously displace them in opposite directions toward one another to their closed position and away from one another to their open position. The control means include four double-acting hydraulic jacks 51 which have their cylinder ends pivotally connected to the vertical walls 56, 57, which extend longitudinally between and are rigidly secured, as by welding, to the endwalls of adjacent hoppers. The vertical walls 56, 57 are also welded at their upper ends to the underside of a horizontal wall 61. The outboard ends of the jacks 51 are pivotally connected to the upper outboard corners of the panels 31, 32. The double-acting jacks 51, and tracks 41, 42, 43 and 44 are disposed beneath a protective box structure defined by endwalls 38, 39 and a horizontal wall 61. The outboard ends of tracks 41 42, 43, 44 are supported on support columns in the form of vertical H-beams 66 by being welded to brackets 71, 72 which in turn are welded to the H-beams 66. The H-beams are in supporting relation to the horizontal wall member 61.

Figure 5:
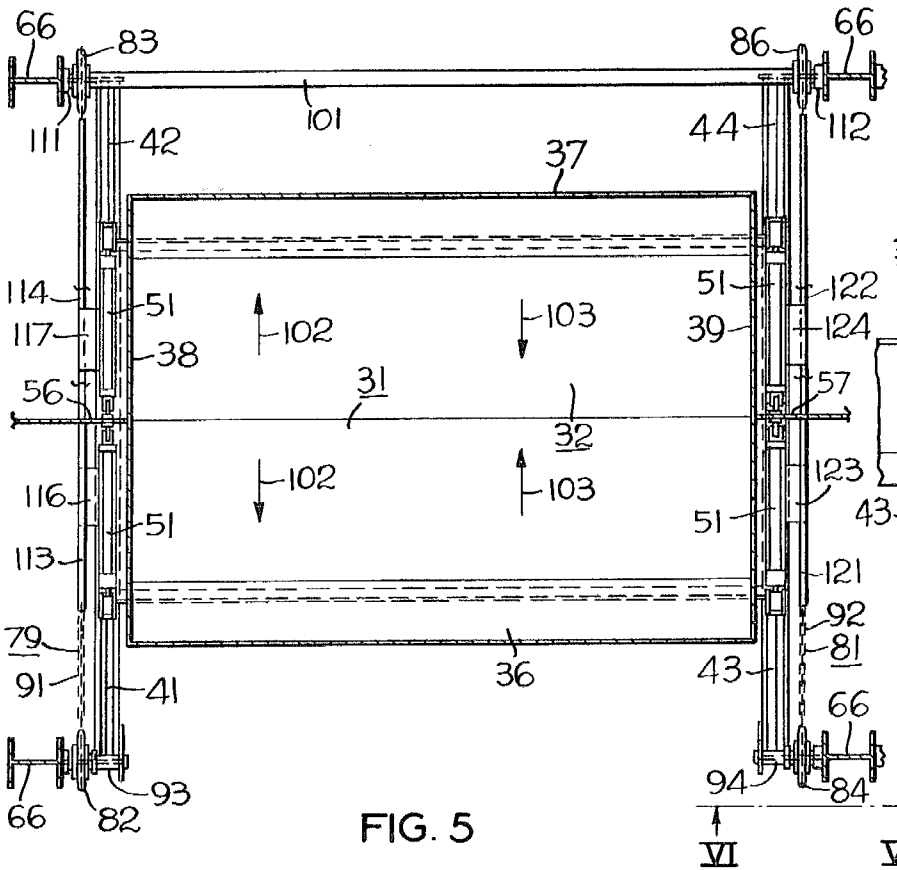
FIG. 5 is a view taken along the line V—V in FIG. 3.

The control means for simultaneously displacing the closure panels 31, 32 also includes a pair of chain and sprocket mechanisms 79, 81 which include a pair of chain means 91, 92 and four sprockets 82, 83, 84 and 86 at the outboard ends, respectively, of the tracks 41, 42, 43, 44. As shown in FIG. 5, the sprockets 82, 83, 84, 86 are at the outer corners of the closure panels 31, 32 when the latter are in their open positions. The sprockets 82, 84 are rotatably supported on shafts 93, 94 which are mounted on the H-beams 66, by suitable mounting brackets. As shown in FIG. 3, the opposite ends of shaft 93 are mounted on brackets 106, 107 and the opposite ends of shaft 94 are mounted on brackets 108, 109. The brackets 106 and 109 are welded to the H-beams 66 and the brackets 107 and 108 are secured as by welding to the tracks 41, 43. The sprockets 83, 86 are nonrotatably secured in coaxial relation to a longitudinal, horizontal shaft 101 which extends transverse to the directions of opening and closing movement of the panels 31, 32 indicated by arrows 102, 103, respectively. The opposite ends of the shaft 101 are rotatably supported by bearing blocks 111, 112 welded to confronting sides of longitudinally spaced vertical H-beams 66.

Figure 7:
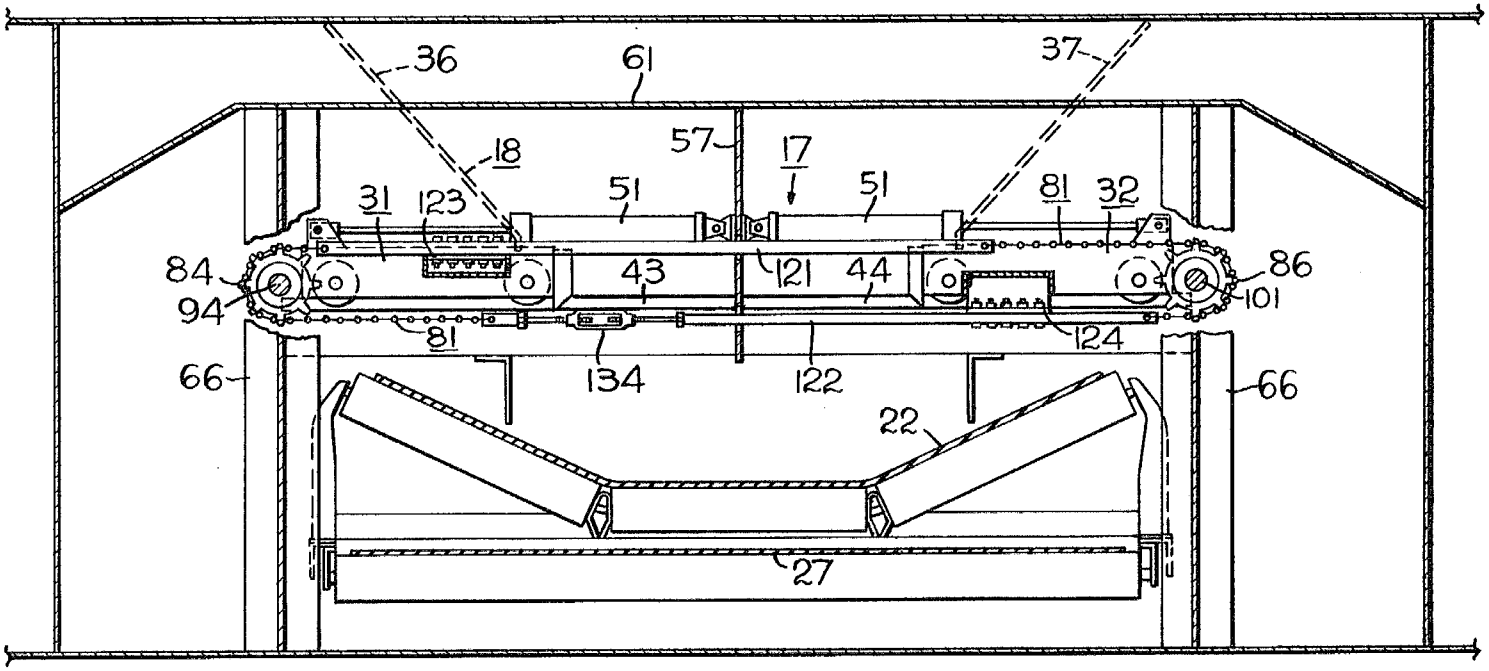
FIG. 7 is a view similar to FIG. 2 except showing the gate closure panels in their open positions.

The double-acting jacks 51 are connected in parallel by a conventional hydraulic control circuit, not shown, by which an operator can cause the jacks to be simultaneously actuated, that is, simultaneously extended or simultaneously retracted. In FIGS. 2, 3, 4 and 5, the jacks 51 are retracted and the closure panels 31, 32 are in their inboard, closed positions. When the jacks 51 are extended, the panels 31, 32 are simultaneously moved in opposite horizontal directions, indicated by arrows 102, to their outboard, open positions, as shown in FIG. 7.

The endless chain means 79 has elongated bar segments 113, 114 which are bolted to flanges 116, 117 welded, respectively, to upper and lower portions of corresponding longitudinal ends of the closure panels 31, 32. In a similar manner, elongated bar segments 121, 122 of endless chain means 81 are bolted to flanges 123, 124 welded to upper and lower portions of the other corresponding longitudinal ends of closure panels 31, 32. The bar segments extend through appropriate openings in the central vertical walls 56, 57. In FIG. 2, bar segments 121, 122 are shown extending through openings 126, 127 in the vertical wall 57. Also, as shown in FIG. 2, chain segments 131, 132 of endless chain means 81 operatively engage sprockets 84, 86 whereby lengthwise movement of the chain segments cause rotation of the sprockets. It will also be noted that a turnbuckle 134 is provided in the endless chain means 81 so as to facilitate assembly, disassembly and adjustment of its length. The details of endless chain means 81 and its relationship with the other ends of closure panels 31, 32 and sprockets 84, 86 are similar to that described for endless chain means 79. The illustrated embodiment of the invention is compact, particularly in vertical dimension with the axes of the rollers 46 and sprockets 82, 83, 84, 86, lying in substantially the horizontal plane 40 of the closure panels 31, 32.

OPERATION

When the jacks 51 are contracted the closure panels 31, 32 of the gate mechanism 17 are in their closed or inboard position as shown in FIGS. 2, 4 and 5. When the jacks 51 are extended the closure panels 31, 32 will simultaneously open by equal translational movement to their open or outboard position as shown in FIG. 7. The expansion of the jacks 51 can, of course, be halted at any intermediate point so as to partially open the closure panels. Since the upper runs of chain means 79, 81 are connected to opposite longitudinal ends of the closure panel 31 and the lower runs of chain means 79, 81 are connected to opposite longitudinal ends of the closure panel 32, the closure panels 31, 32 must open at the same speed and the same amount. The torque transmitting connection effected by the shaft 101 secured for rotation with sprockets 83, 86 synchronizes movement of the opposite ends of each panel. In other words, the shaft 101 insures translational movement of the panels 31, 32. Although the grooved rollers 46 and inverted V-shaped cross-section of the upper part of the tracks tend to effect uniform displacement of all parts (translational movement) of either one of the closure panels, the chain means 79, 81 sprockets 82, 83, 84, 86 and shaft 101 positively assure simultaneous, equal displacement of the panels 31, 32 in opposite horizontal directions and assure that each portion of the panels 31, 32 is displaced through a distance equal to the distance through which any other portion of a panel of the pair of panels 31, 32 is displaced.

The embodiments of the invention in which an exclusive property or privilege is claimed are defined as follows:

1. A bulk cargo ship having a plurality of longitudinally spaced gated hoppers in the bottom of its holds for gravity discharge of bulk material onto an endless belt moving lengthwise of the ship characterized by:

a gate mechanism for each hopper for metering discharge of material therefrom including a pair of horizontally disposed closure panels at said discharge opening selectively shiftable between open and closed positions, support means for supporting said pair of panels for translational movement in opposite horizontal directions between said open and closed positions including horizontal tracks along opposite sides of said discharge opening supporting opposite end portions of said closure panels and vertical support columns supporting the outboard ends of said tracks and the associated hopper, and control means for simultaneously displacing said closure panels in opposite directions toward one another to their closed positions and for simultaneously displacing said closure panels away from one another to their open positions, said control means including a first pair of sprockets rotatably mounted on said support means by a first shaft means supported at least in part by said vertical support columns on a pair of parallel horizontal axes extending transverse to the direction of movement of said panels, a second pair of sprockets rotatably mounted on said support means by a second shaft means supported at least in part by said vertical support columns on a pair of parallel horizontal axes extending transverse to the direction of movement of said panels, first chain means lying alongside one of said support means and operatively engaging said first pair of sprockets so as to form an endless loop with a pair of runs which move, respectively, in said opposite horizontal directions, second chain means lying alongside the other of said support means and operatively engaging said second pair of sprockets so as to form an endless loop with a pair of runs which move, respectively, in said opposite horizontal directions, a first pair of fastening means connecting opposite end portions of one of said panels to one set of corresponding runs of said first and second chain means, a second pair of fastening means connecting opposite end portions of the other of said panels to the other set of corresponding runs of said first and second chain means, and torque transmitting means interconnecting one of said first pair of sprockets to one of said second pair of sprockets whereby corresponding runs of said first and second chain means move in the same direction at the same speed thereby effecting synchronized translational movement of said closure panels.

2. The ship of claim 1 wherein each of said sprockets is adjacent a longitudinal side of one of said vertical columns.

3. The ship of claim 1 and support rollers for said endless belt and frame structure rotatably supporting said support rollers, said frame structure being supported by said vertical columns.

* * * * *